US011986711B1

(12) United States Patent
Dewhurst

(10) Patent No.: US 11,986,711 B1
(45) Date of Patent: May 21, 2024

(54) GOLF PUTTER

(71) Applicant: PureStrike Dynamics LLC, Port Orange, FL (US)

(72) Inventor: Peter Dewhurst, Port Orange, FL (US)

(73) Assignee: PureStrike Dynamics LLC, Port Orange, FL (US)

( * ) Notice: Subject to any disclaimer, the term of this patent is extended or adjusted under 35 U.S.C. 154(b) by 0 days.

(21) Appl. No.: 18/405,713

(22) Filed: Jan. 5, 2024

(51) Int. Cl.
*A63B 53/04* (2015.01)
*A63B 53/00* (2015.01)

(52) U.S. Cl.
CPC ..... *A63B 53/0487* (2013.01); *A63B 53/007* (2013.01)

(58) Field of Classification Search
CPC . A63B 53/0487; A63B 53/007; A63B 53/065; A63B 60/52; A63B 60/54; A63B 53/021; A63B 53/02
USPC ..... 473/340–341, 313, 244–248, 305–307
See application file for complete search history.

(56) References Cited

U.S. PATENT DOCUMENTS 4,815,739 A 3/1989 Donica
5,643,109 A * 7/1997 Rose ..... A63B 53/0487 473/340
7,077,758 B2 7/2006 Rohrer
7,347,793 B2 * 3/2008 Davis ..... A63B 53/0487 473/340
7,396,294 B2 7/2008 Consiglio
7,407,443 B2 8/2008 Franklin
7,674,186 B2 * 3/2010 Bitko ..... A63B 60/02 473/340
7,815,420 B2 * 10/2010 Koehl ..... G05B 15/02
7,854,665 B2 12/2010 Dewhurst
8,506,415 B2 8/2013 Franklin
8,597,136 B1 * 12/2013 Grossbard ..... A63B 53/007 473/340
9,144,717 B2 9/2015 Franklin
9,174,102 B2 11/2015 Stevenson
9,662,545 B2 5/2017 Beach
11,813,508 B2 * 11/2023 Higdon ..... A63B 53/0487
2008/0293513 A1 * 11/2008 Bitko ..... A63B 60/02 473/340
2009/0170629 A1 7/2009 Hilton
2010/0227704 A1 9/2010 Souza
2013/0095953 A1 * 4/2013 Hotaling ..... B23P 17/04 473/332
2014/0024473 A1 * 1/2014 Reid ..... A63B 53/007 473/313

(Continued)

FOREIGN PATENT DOCUMENTS

WO WO-2004078274 A1 * 9/2004 ..... A63B 53/02

*Primary Examiner* — Sebastiano Passaniti
(74) *Attorney, Agent, or Firm* — Mitchell Mehlman, Esq.

(57) ABSTRACT

An improved golf putter is provided. In one aspect, the putter has an isolated face. The face is connected to a semicircular support member forming a semicircular aperture between the face and the support member. A pair of ribs is connected to the semicircular support member and forms a first aperture therebetween. A first wall is connected to the pair of radial ribs and to a second wall. The first wall and the second wall are separated by a connecting wall, and form at least two apertures therebetween. A plurality of gaps is formed between the first wall and the face. The plurality of gaps structurally isolates the face from the structure thereby forming an improved golf putter.

20 Claims, 5 Drawing Sheets

(56) References Cited

U.S. PATENT DOCUMENTS

| | | | | |
|---|---|---|---|---|
| 2018/0093143 | A1* | 4/2018 | Onuki | A63B 60/52 |
| 2019/0374831 | A1* | 12/2019 | Onuki | A63B 60/50 |
| 2020/0346084 | A1* | 11/2020 | Varshney | A63B 53/007 |
| 2021/0339098 | A1 | 11/2021 | Scott | |
| 2023/0226418 | A1 | 7/2023 | Meyer | |
| 2023/0249039 | A1 | 8/2023 | Degerness | |
| 2023/0364479 | A1 | 11/2023 | Serrano | |

* cited by examiner

GOLF PUTTER

FIELD OF THE INVENTION

The present invention is generally directed to the technical field of golf clubs and more specifically to novel golf putters designed to be both structurally efficient and accurate thus allowing more traditionally sized putters to have large moments of inertia.

BACKGROUND OF THE INVENTION

A putter is a club used in the sport of golf to make relatively short and low-speed strokes with the intention of rolling the ball into the hole from a distance away. It is differentiated from the other clubs (typically, irons, and woods) by a clubhead having a flat, low-profile, low-loft striking face, and by other features which are only allowed on putters, such as bent shafts, non-circular grips, and positional guides.

Putters are generally used from very close distances to the hole or cup, generally on the putting green, though certain courses have fringes and roughs near the green which are also suitable for putting. While no club in a player's bag is absolutely indispensable nor required to be carried by strict rules, the putter comes closest. It is a highly specialized tool for a specific job, and virtually no golfer is without one.

Putting is the most precise aspect of the game of golf. The putter must be designed to give the golfer every opportunity including smooth stroke, good glide, sweet impact, and bounce-less topspin ball launch as well as every technique advantage including optimized fit as to shaft angle and length.

The striking face of a putter is usually not perpendicular to the ground: putters typically have a small amount of loft, intended to "lift" the ball out of any depression it has made or settled into on the green, which reduces bouncing. This loft is typically 5-6°, and by strict rules cannot be more than 10°. The putter is the only club that may have a grip that is not perfectly round; "shield"-like cross-sections with a flat top and curved underside are most common. The putter is also the only club allowed to have a bent shaft. Many putters also have an offset hosel, which places the shaft of the club in line with the center of the ball at impact to improve stability and feel.

Historically putters were known as "putting cleeks" and were made entirely from woods such as beech, ash, and hazel. In the 1900s putter heads evolved, with iron club heads becoming a more popular design. The design of the putter's club head has undergone radical changes since the late 1950s. Putters were originally a forged iron piece very similar in shape to the irons of the day. One of the first to apply scientific principles to golf club design was engineer Karsten Solheim. In 1959, instead of attaching the shaft at the heel of the blade, Solheim attached it in the center, transferring much of the weight of the club head to the perimeter.

Through attempts to lower the center of gravity of the club head, designs evolved into a shorter, thicker head slightly curved from front to rear (the so-called "hot dog" putter). The introduction of investment casting for club heads allowed drastically different shapes to be made far more easily and cheaply than with forging, resulting in several design improvements. First of all, the majority of mass behind the clubface was placed as low as possible, resulting in an L-shaped side profile with a thin, flat club face and another thin block along the bottom of the club behind the face.

Additionally, peripheral weighting, or the placing of mass as far away from the center of the clubface as possible, increases the moment of inertia of the club head, reducing twisting if the club contacts the ball slightly off-center and thus giving the club a larger "sweet spot" with which to contact the ball. Newer innovations include replacing the metal at the "sweet spot" with a softer metal or polymer compound that will give and rebound at impact, which increases the peak impulse (force×time) imparted to the ball for better distance. Putters can be subdivided into mallet, peripheral weighted and blade styles.

In the world of golf, putter innovations have been continuous, with manufacturers striving to improve performance, feel, and alignment for golfers on the putting green.

Some innovations include one or more of the following:

The use of inserts made from various materials, such as polymers or elastomers, has become a common feature in modern putter designs. These inserts are often placed on the face of the putter to enhance the feel of the ball at impact and provide better feedback to the golfer. The goal is to create a softer feel while maintaining consistent distance control.

Mallet putters have evolved significantly in terms of design and alignment features. Modern mallet putters often have larger and more intricate head shapes, which can provide higher levels of forgiveness and stability on off-center hits. The added weight and unique shapes contribute to improved moment of inertia (MOI) and overall performance.

Many contemporary putters feature adjustable weighting systems that allow golfers to customize the balance and feel of the putter. These systems typically involve movable weights on the sole of the putter, enabling golfers to fine-tune the club's performance to suit their stroke and preferences.

Precision face milling has become a focal point in putter design. Manufacturers use various face milling patterns to influence the ball's roll and improve consistency. Different milling patterns can enhance grip on the ball, reduce skidding, and promote a smoother roll for improved accuracy.

Counterbalanced putters are designed with a heavier grip and often a longer shaft to shift the balance point of the putter toward the golfer's hands. This design is believed to promote a smoother and more stable putting stroke, particularly for golfers who struggle with consistency.

Moment of Inertia (MOI) is a measure of a putter's resistance to twisting on off-center hits. High MOI putters are designed to be more forgiving, helping golfers maintain accuracy even on mis-hits. This is especially beneficial for golfers who seek increased stability in their putting stroke.

Improved alignment aids are a common feature in modern putters. These aids, such as contrasting lines, dots, or shapes on the top of the putter head, help golfers align the putter more accurately to their target. Enhanced alignment features aim to improve consistency in setup and stroke.

With the rise of technology in golf, some putters now come equipped with sensors or smart features. These putters can provide data on the golfer's putting stroke, including metrics like tempo, face angle, and impact speed. Golfers can use the data to analyze and refine their putting technique.

Advances in materials, such as the use of lightweight metals and composite materials, contribute to the overall design and performance of modern putters. These materials help manufacturers optimize weight distribution and create putters with improved balance and feel.

Golfers today have access to a wide range of customization options, allowing them to tailor their putters to personal preferences. This includes options for grip size, shaft length, and head weight, providing golfers with the opportunity to find the ideal combination for their putting style.

Overall, the continuous innovation in golf putters reflects a commitment to enhancing the overall putting experience for golfers of all skill levels. Whether through advanced materials, intricate designs, or technological integrations, putter manufacturers continue to push the boundaries of what is possible in pursuit of improved performance on the greens.

A large number of golf putting clubs are known, several examples are enumerated below.

U.S. Pat. No. 11,813,508 ("Higdon") teaches multi-component putters comprising an upper portion and a lower portion. The upper portion is formed from a first material having a first density and the lower portion is formed from a second material having a second density. The first density is less than the second density. The upper portion is affixed to the lower portion via an adhesive or a combination of adhesives and interlocking geometry. The multi-component putter design provides increased forgiveness and moment of inertia compared to a putter formed from a single material.

U.S. Pat. No. 9,662,545 ("Beach") discloses a golf club head including a face; a body, the body defining an interior and an exterior. The face and the body together defining a center of gravity, the center of gravity being proximate the face. A coefficient of restitution feature is defined in the body; wherein the coefficient of restitution feature defines a gap in the body. A golf club head includes a face and a golf club body; the face and the golf club body defining a center of gravity, the center of gravity defined a distance, A, from a ground plane as measured along a Z-axis, the center of gravity defined a distance, CG, from the center face along the y-axis.

U.S. Pat. No. 9,174,102 ("Stevenson") discloses a putter head includes a hosel connectable to a club shaft, a frame cooperable with the hosel, and a putter face connected to the frame. The putter face includes a toe portion including a corresponding toe shoulder and a heel portion having a corresponding heel shoulder. The toe shoulder and the heel shoulder define an encasement. Weights are positioned in the encasement respectively adjacent the toe shoulder and the heel shoulder.

U.S. Pat. No. 9,144,717 ("Franklin") discloses a putter head including a putter body having a base member defining a ball striking face surface. The putter body further has a first arm extending away from the base member and a second arm extending away from the base member, and a central member extending away from the base member and positioned between the first arm and the second arm. A weight assembly is supported by the putter body. The weight assembly has a beam member having a first end, a second end and a central portion. The central portion is supported by the central member along a first plane, and the first end of the beam member is supported by the first arm along a second plane. The second plane is generally transverse to the first plane.

U.S. Pat. No. 8,506,415 ("Franklin II") discloses putter heads and putters include one or more of: (a) a main putter body portion including a first arm and a second arm; (b) a first polymeric and/or damping element engaged with the first arm; and (c) a second polymeric and/or damping element engaged with the second arm. The putter heads further may include polymeric material within the putter head structure and exposed at a central ball striking portion of the ball striking face, e.g., in elongated openings provided in the ball striking face. Grooves may be provided in the material of the ball striking face and/or in the exposed polymeric material to affect the ball launch. The putter heads may have various additional features or structures, e.g., relating to weighting features, alignment aid features, putter head constructions or parts, polymeric material exposure features, groove features, etc.

U.S. Pat. No. 7,854,665 ("Dewhurst") discloses a golf club head designed to act under impact load. The head comprising a face; an inertial support system; a rear structure; and a force transfer system. Under impact load the force transfer system, in cooperation with the inertial support system, elongates the rear structure and controls the bending of the face. The pattern of bending of the face being a substantially bridge-like pattern of bending or a substantially modified bridge-like pattern of bending.

U.S. Pat. No. 7,407,443 ("Franklin III") discloses golf club heads (including putter heads), have a high moment of inertia about their center, to help prevent twisting and mis-hits, particularly when the ball striking device hits the ball at a somewhat off-center position. The ball striking head of the ball striking device may be structured and/or weighted (optionally with separately attachable weight elements) to have a moment of inertia about a center of the ball striking surface of at least 10,000 g-cm2, and in some examples, the moment of inertia may be at least 11,000 g-cm2, or even at least 12,000 g-cm2. In some examples, the moment of inertia may be at least 20,000 g-cm2, or even at least 25,000 g-cm2 or at least 28,000 g-cm2.

U.S. Pat. No. 7,396,294 ("Consiglio") teaches a golf putter including an elongated handle terminating in a three-dimensional shaped putter head exhibiting a substantially smooth ball striking face. A vibration inducing component being mounted to first and second locations associated with a surface of the putter head and located opposite the ball striking face. Upon impacting a golf ball offset from a center line associated with the striking face, the vibration inducing components counteract twisting of the putter head, thereby increasing an effective surface area of the striking face creating a perpendicular travel direction of the ball relative to the putting face.

U.S. Pat. No. 7,077,758 ("Rohrer") relates to a golf putter in which most of the clubhead mass is distributed at three or more individual or one or more arcuate locations within a "Mass Ring" approximately equidistant from, and as remote as possible from, the clubhead planar center of mass. The club shaft axis preferably forward of the clubhead center of mass thus maximizing both putter and clubhead planar moment of inertia for improved putter performance during mis-hits. Maximum remote mass is achieved by interconnecting the remote high mass areas (Mass Ring) with the putter face striking area and the putter shaft connection point with a light weight rigid open (see thru) (sic.) truss system so arranged to enhance the visibility of the Sighting Field and/or aim or Sight Line on the putter head while preventing undesirable vibration of individual clubhead members.

U.S. Pat. No. 4,815,739 ("Donica") discloses a golf putter which provides an enlarged "sweet spot" by connecting the shaft to a rearwardly extending semi-circular support so as to disjoin the shaft directly from the putter's faceplate or blade. The support consists of a plurality of spoke-like members extending to an attachment locus toward, but not touching the rear face of the faceplate; thus, causing the force of a struck ball to be transmitted to the shaft.

U.S. Pub. No. 2023/0364479 ("Serrano") teaches a compact putter-type club head comprising a compact body profile and a small strike surface area. The compact putter head achieves distinct alignment and delivery advantages under a variety of putting conditions and is uniquely suited to produce accurate putting from the rough or fringe. The small body dimensions, including the strike face, force the player to focus on making a center strike, while also providing minimal resistance when travelling through tall grass. Certain features and characteristics of the compact putter head are specifically tailored to produce one of these benefits, while certain other features or characteristics provide benefits across multiple areas.

U.S. Pub. No. 2023/0249039 ("Degerness") discloses a blade style putter type club head comprising enlarged physical features such as an enlarged length, height, and depth. The enlarged physical features, specifically the enlarged length allows mass to be positioned further from the center of gravity. The positioning of the mass away from the center of gravity allows the blade style club head to achieve an increased MOI creating a more forgiving blade style putter type club head.

U.S. Pub. No. 2023/0226418 ("Meyer") teaches a putter including a composite putter head having a high moment of inertia. The putter also includes a putter head face connected to the composite putter head. The putter further includes a hosel for mounting to a putter shaft. The putter also includes a plurality of sole weights mounted in a sole of the composite putter head.

U.S. Pub. No. 2021/0339098 ("Scott") illustrates a golf putter clubhead designed with a unique structure using a geometry and a balance technology to provide super symmetry, harmony, and balance at motion and at rest. The clubhead includes a body with triangular members, a putting face, and optional holes. The triangular form clubhead does not require compensation during the swing thus allowing for greater repetition and simplicity of movement in turn producing performance benefits via consistency. The geometric triangular shape of the clubhead provides an instantly recognizable assistance in proper alignment at the rest position. The body of the clubhead may be hollow and feature inner symmetrical structures to complement the form of the body and to enhance and provide superior weight distribution and balance, thus, providing a performance edge in swing consistency and performance, and allowing for repeatability of the clubhead.

U. S. Pub No. 2010/0227704 ("Souza") discloses a golf club head can include: (a) a face member; and (b) a rear section coupled to the face member. The rear section can include an edge. The edge can be substantially circular in shape. A diameter of the edge can be equal to a diameter of a regulation golf hole.

U.S. Pub. No. 2009/0170629 ("Hilton") discloses a putter-type club head having a main body and a removable aft member. The putter type club head has a main body that is preferably composed of an aluminum alloy. The removable aft member is preferably composed of stainless steel.

None of the known devices disclose or suggest improved golf putters having an isolated face which changes the deformation mode from other known devices. The present invention can include putters having a mass concentrated in an outer portion and as such, can be considered as Michell minimum-mass structures. The isolated putter face, which can be designed to be structurally isolated from the rear structure mass by a minimum weight structure. This allows the front and rear to be isolated, allowing different putter styles to have the same feel. This appears to be accomplished in other putters by having soft polymer inserts which produce the same soundless soft impact for a range of styles and sizes.

Therefore, there is a need for improved golf putters and putting head which can assist a golfer to achieve better precision, higher moment of inertia (MOI) better accuracy, and ultimately, better golf scores.

SUMMARY OF THE INVENTION

In one aspect the present invention includes a mallet style putter. The putter includes a face having a length. The face can be connected to a semicircular support member forming a first semicircular aperture between the face and the semicircular support member. A plurality of radial ribs can be connected to the semicircular support member and can form a first plurality of apertures therebetween. A first wall can be connected to the plurality of radial ribs and to a second wall in a concentric semicircular arrangement. The first wall and the second wall can be separated by a connecting wall and can form a second plurality of apertures therebetween. A plurality of gaps can be formed between the first wall and the face. The plurality of gaps structurally isolates the face from the first wall and from the second wall. A hosel can include a first cylindrical receptacle, a second cylindrical receptacle, and a stud. The stud can protrude from a semicircular portion of the first wall. The stud can be connected to the second cylindrical receptacle and a shaft can be connected to the first cylindrical receptacle.

In one embodiment, the first semicircular aperture can be filled with a high-density material.

In some embodiments, at least one of the first plurality of apertures can be filled with a high-density material.

In certain embodiments, at least one of the second plurality of apertures can be filled with a high-density material.

In some embodiments, the high-density material can have a density between about 5 g/cc and about 20 g/cc.

In certain embodiments, the high-density material can comprise tungsten powder.

In some embodiments, the high-density material can be patterned or dimpled like a golf ball.

In yet other embodiments, wherein the plurality of radial ribs can be four radial ribs.

In some embodiments, the first plurality of apertures can be three apertures.

In certain embodiments, the second plurality of apertures can be five apertures.

In other embodiments, the plurality of radial ribs can be four radial ribs, the first plurality of apertures can be three apertures and the second plurality of apertures can be five apertures.

In some embodiments, wherein the face length can be between about 1.5 inches and about 3 inches.

Another aspect of the present invention includes a blade style putter. The putter comprises a face having a length. The face can be connected to a semicircular support member forming a semicircular aperture between the face and the support member. A pair of ribs can be connected to the semicircular support member and can form a first aperture therebetween. A first wall can be connected to the pair of radial ribs and to a second wall. The first wall and the second wall can be separated by a connecting wall, and can form at least two apertures therebetween. A plurality of gaps can be formed between the first wall and the face. The plurality of gaps can structurally isolate the face from the first wall and from the second wall. A hosel can include a first cylindrical receptacle, a second cylindrical receptacle, and a stud. The stud can protrude from a semicircular portion of the first wall. The stud can be connected to the second cylindrical receptacle and a shaft can be connected to the first cylindrical receptacle.

In some embodiments of this aspect, the semicircular aperture can be filled with a high-density material.

In other embodiments, the first aperture can be filled with a high-density material.

In a particular embodiment, at least one of the at least two of apertures is filled with a high-density material.

In some embodiments, the high-density material can have a density between about 5 g/cc and about 20 g/cc.

In some embodiments, the high-density material can comprise tungsten powder

In certain embodiments, the high-density material can be patterned or dimpled like a golf ball In other embodiments, the face length can be between about 1.5 inches and about 3 inches.

DETAILED DESCRIPTION OF THE INVENTION

The putters described herein comprise a Michell Structure in order to allow a maximum amount of discretionary mass to be used and thereby a large moment of inertia. The putter are designed to offer two significant advantages in performance 1) to eliminate a significant amount of mass from the central areas of the putters to increase the amount of discretionary mass that can be distributed about the rear perimeter of the putters for the purpose of increasing the moment of inertia (MOI) of the putter as a means of improving off center golf ball hit performance and 2) by using a novel radial arm framework, to enable the club face (s) to flex minimally in response to off center impacts thus reducing the loss of energy that typically accompanies off center golf ball impacts.

In combination with the higher MOI, off center hit performance is improved compared to known putters. With known putters, off center impact generally causes the ball to travel a shorter distance with a less solid impact feel than it would have for a putt hit in the center of the face with the same impact velocity.

Figure 1:
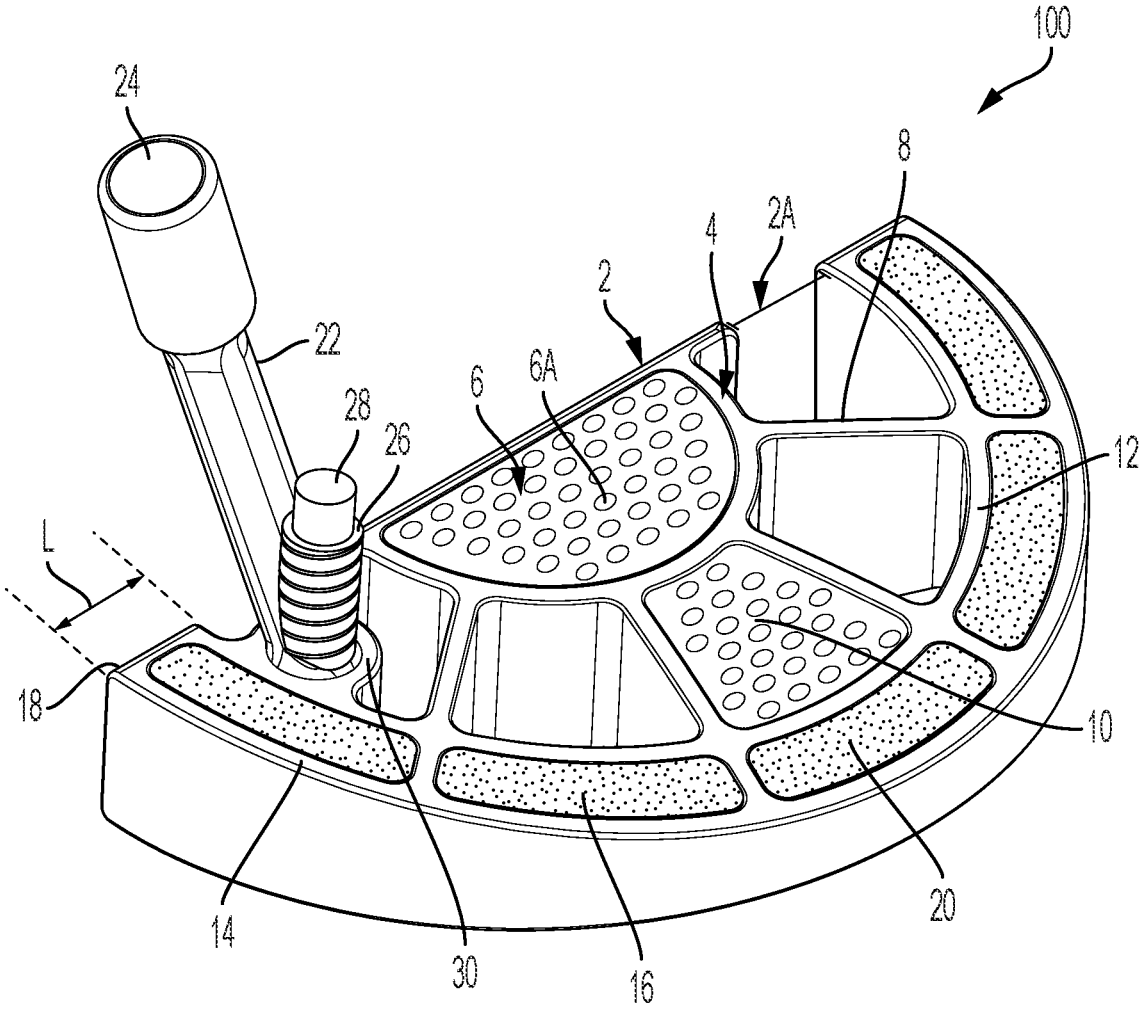
FIG. 1 depicts an isometric view of putter in accordance with one embodiment of the present invention.
Figure 2:
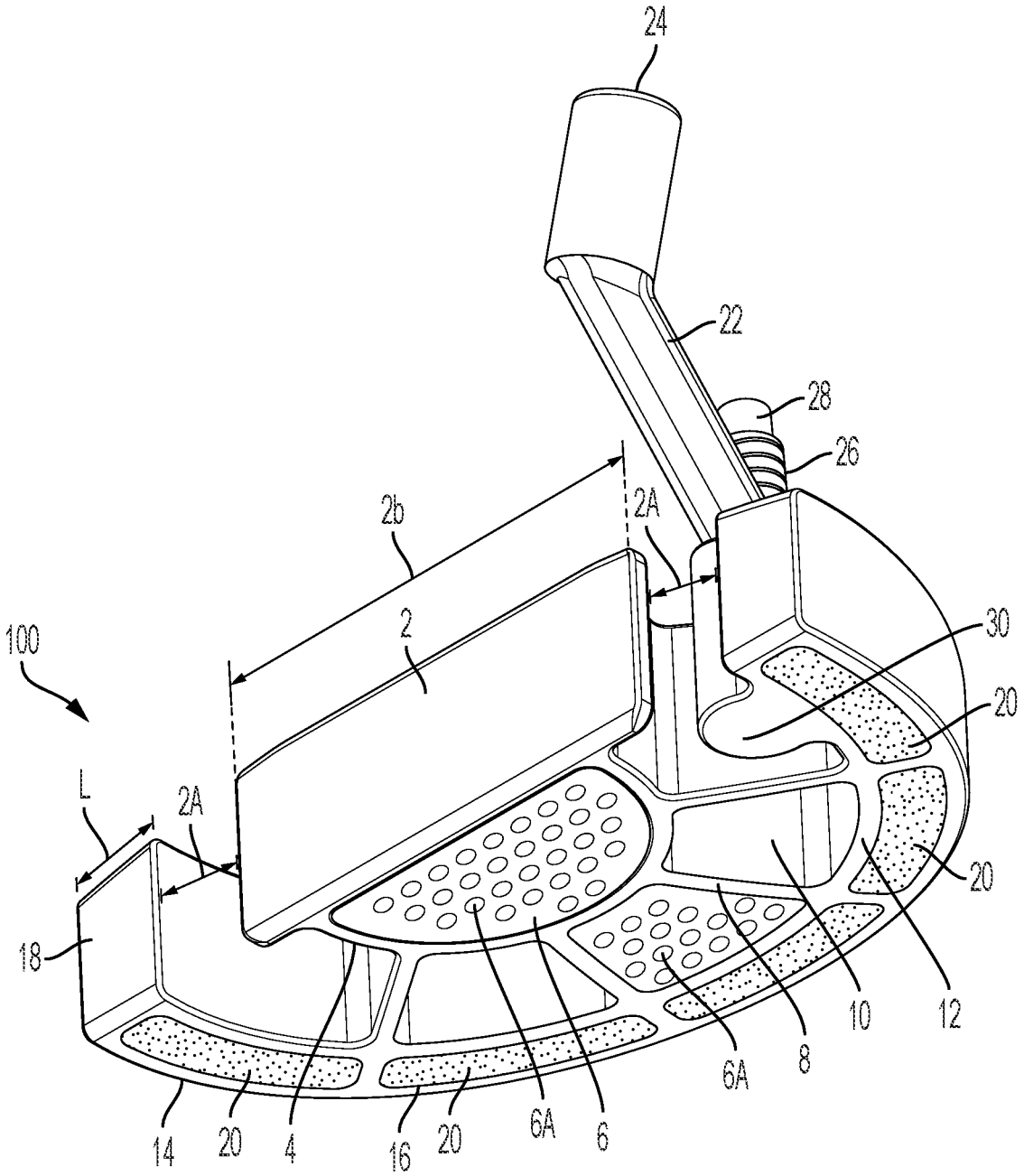
FIG. 2 shows another isometric view of some of the elements of the embodiment shown in FIG. 1.

As shown in FIGS. 1-2, a mallet style putter according to one non-limiting embodiment of the present invention is generally designated by the reference numeral 100. Putter 100 includes a face 2. The face 2 is generally flat and has a length 2*b*. Semicircular support member 4 is connected to the face 2 and forms a semicircular aperture 6 between the face 2 and the support member 4 thereby defining the length of the face 2. In this embodiment, the support member 4 is connected to four rearwardly projecting radial ribs 8 forming three radial apertures 10 therebetween. It should be appreciated that the face 2 is connected to the support member 4 but is not connected to directly to any other structure and is therefore structurally isolated. This feature allows the face 2 to rotate freely without deformation beyond that caused directly by impact with a golf ball during a putting stroke.

In some embodiments, semicircular aperture 6 can be filled with a high-density material as discussed below and/or filled and patterned or dimpled 6A to appear like a golf ball. Face 2 may be configured to length 2*b* about the diameter of a golf ball (i.e. between about 1.5" and about 3", nominally 1.68").

The number of radial ribs 8 and corresponding radial apertures 10 can be sized to fit a plurality of putter 100 designs, for example a putter having five ribs 8 and four radial apertures 10, or six ribs 8 and five radial apertures 10, and the like. In some embodiments, one or more of the radial apertures 10 can be filled. For example, one radial aperture 10 can be filled with a high-density material 20 such as a polymer/high density metal composite and another radial aperture 10 can be filled with a lower density material such as an unfilled optically clear polymer (or air/no material). In an embodiment having three radial apertures 10, the middle radial 10 aperture can be filled with a high-density material 20 and the neighboring radial apertures 10 can be filled with one or more low density materials. In some embodiments, one or more radial apertures 10 can be filled and/or patterned/dimpled 6A to appear like a golf ball.

The radial ribs 8 are connected to a first wall 12. The first wall is connected to a second wall 14 in a concentric semicircular arrangement. The first and second walls 12, 14 are separated by a connecting wall 18 having a length L. In some embodiments, the first and second walls 12, 14 have a radius of R1 and R2, respectively where R2=R1+L. Gaps 2A form spaces between first wall 12 and face 2 thus, structurally isolating face 2 from the portion of the structure formed by first and second walls 12, 14.

First and second walls 12, 14 can form semicircular apertures 16 therebetween. In some embodiments, the semicircular apertures 16 are filled. In certain embodiments the semicircular apertures 16 are filled with a high-density material 20. The high-density material 20 can be mixture of metallic powder and polymer resin, the metallic powder can be tungsten and polymer resin can be epoxy. The mass of the high-density material can be between about 60% and about 90% of the mass of the putter 100. In some embodiments the mass of the high-density material can be about 80% of the mass of the putter 100. The density of the high-density material is preferably in the range of between about 5 g/cc and about 20 g/cc.

In certain embodiments, some of the radial apertures 10 and/or semicircular apertures 16 can be filled with a high-density material 20 and other radial apertures 10 and/or semicircular apertures 16 can be filled with a lower density material (not shown). The lower density material can be transparent or translucent. In some embodiments the lower density material can be polycarbonate.

The putter 100 also includes hosel 22 which is used to connect the putter 100 to a golf shaft 302. See e.g. FIG. 5. The hosel 22 includes a first cylindrical receptacle 24 for shaft 302 connection and a second cylindrical receptacle 26 for connecting to stud 28. Stud 28 protrudes from semicircular portion 30 of first wall 12. In practice, the golf club shaft 302 can be inserted into/or over first cylindrical receptacle 24 and adhesively bonded thereto. Likewise, second cylindrical receptacle 26 can be secured to stud 28, thereby forming an improved putter 100, 300 for use in playing golf.

Figure 3:
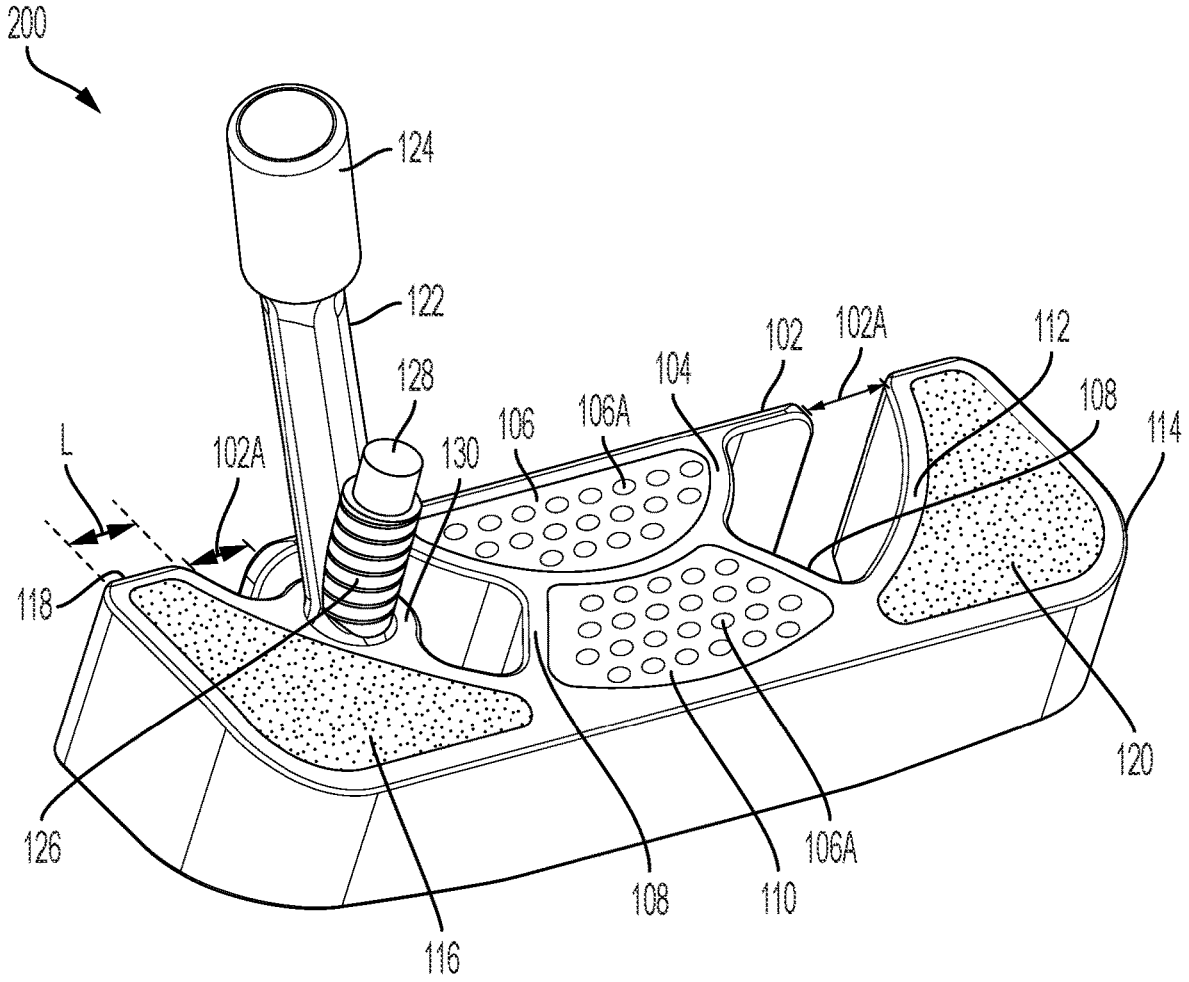
FIG. 3 depicts an isometric view of putter in accordance with another non-limiting embodiment of the present invention.
Figure 4:
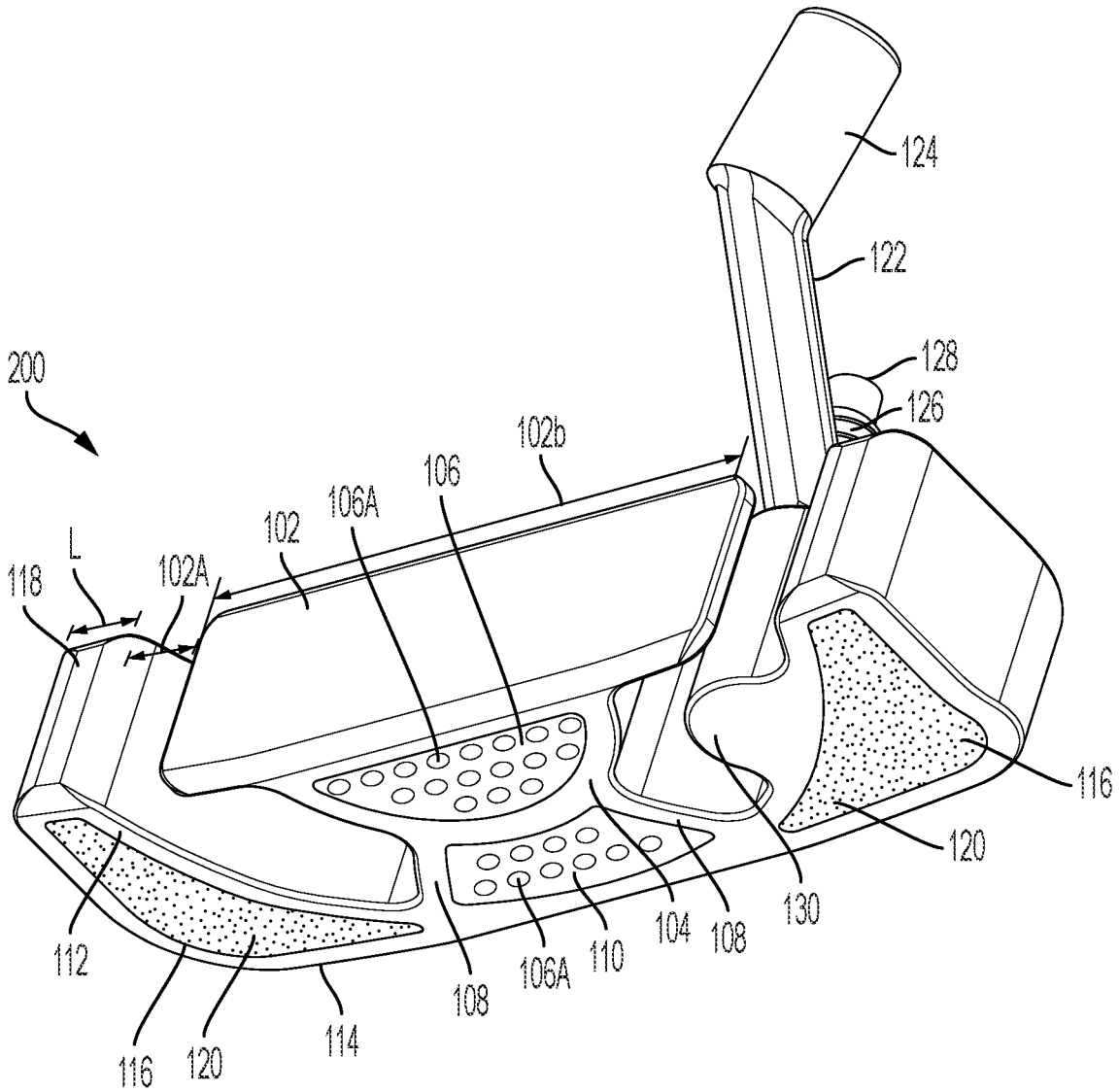
FIG. 4 shows another isometric view of some of the elements of the embodiment shown in FIG. 3.

In another aspect of the present invention as shown in FIGS. 3-4, a blade style putter according to one non-limiting embodiment of the present invention is generally designated by the reference numeral 200. Putter 200 includes a face 102. The face 102 is generally flat and has a length 102*b*. Semicircular support member 104 is connected to the face 102 and forms a semicircular aperture 106 between the face 102 and the support member 104 thereby defining the length 102*b* of the face 102. In this embodiment, the support member 104 is connected to two rearwardly projecting radial ribs 108 forming three radial aperture 110 therebetween.

It should be appreciated that the face 102 is connected to the support member 104 but is not connected to any other structure. This feature allows the face 102 to rotate freely without deformation beyond that caused directly by impact with a golf ball during a putting stroke. In some embodiments, semicircular aperture 106 can be filled with a high-density material and/or patterned or dimpled 106A to appear like a golf ball. Face 102 may be configured to be about the diameter of a regulation golf ball (i.e. between about 1.5" and about 3", nominally 1.68").

The number of radial ribs 108 and corresponding radial apertures 110 can be sized to fit a plurality of putter or blade putter 200 designs, for example a putter having three ribs 108 and two radial apertures 110, or four ribs 108 and three radial apertures 110, and the like.

In some embodiments, one or more of the radial apertures 110 can be filled. For example, one radial aperture 110 can be filled with a high-density material 120 and another radial aperture 110 can be filled with a lower density material (or air/no material). In an embodiment having three radial apertures 110, the middle radial 110 aperture can be filled with a high-density material 120 and/or material patterned or dimpled 106A to look like a golf ball and the neighboring radial apertures 110 can be filled with one or more low density materials.

The radial ribs 108 are connected to a first wall 112. The first wall is connected to a second wall 114. The first and second walls 112, 114 are separated by a connecting wall 118 having a length L. Gaps 102A form a space between first wall 112 and face 102 thus, structurally isolating face 102 from the portion of the structure formed by first and second walls 112, 114.

First and second walls 112, 114 form one or more apertures 116 therebetween. In some embodiments, the one or more apertures 116 can be filled with a high-density material 120. As discussed above, the high-density material 120 can be mixture of metallic powder and polymer resin, the metallic powder can be tungsten and polymer resin can be epoxy. The mass of the high-density material can be between about 60% and about 90% of the mass of the putter 200. In some embodiments the mass of the high-density material can be about 80% of the mass of the putter 200.

In certain embodiments, some of the radial apertures 110 and/or semicircular apertures 116 can be filled with a high-density material 120 and other radial apertures 110 and/or semicircular apertures 116 can be filled with a lower density material (not shown). The lower density material can be transparent or translucent. In some embodiments the lower density material can be polycarbonate.

The putter 200 also includes hosel 122 which is used to connect the putter head 200 to a golf shaft 302. See FIG. 5. The hosel 122 includes a first cylindrical receptacle 124 for shaft 302 connection and a second cylindrical receptacle 126 for connecting to stud 128. Stud 128 protrudes from semicircular portion 130 of first wall 112. In practice, a golf club shaft 302 can be inserted into/or over first cylindrical receptacle 124 and adhesively bonded thereto. Likewise, second cylindrical receptacle 126 can be secured to stud 128 thereby forming an improved putter 200 for use in playing golf.

Figure 5:
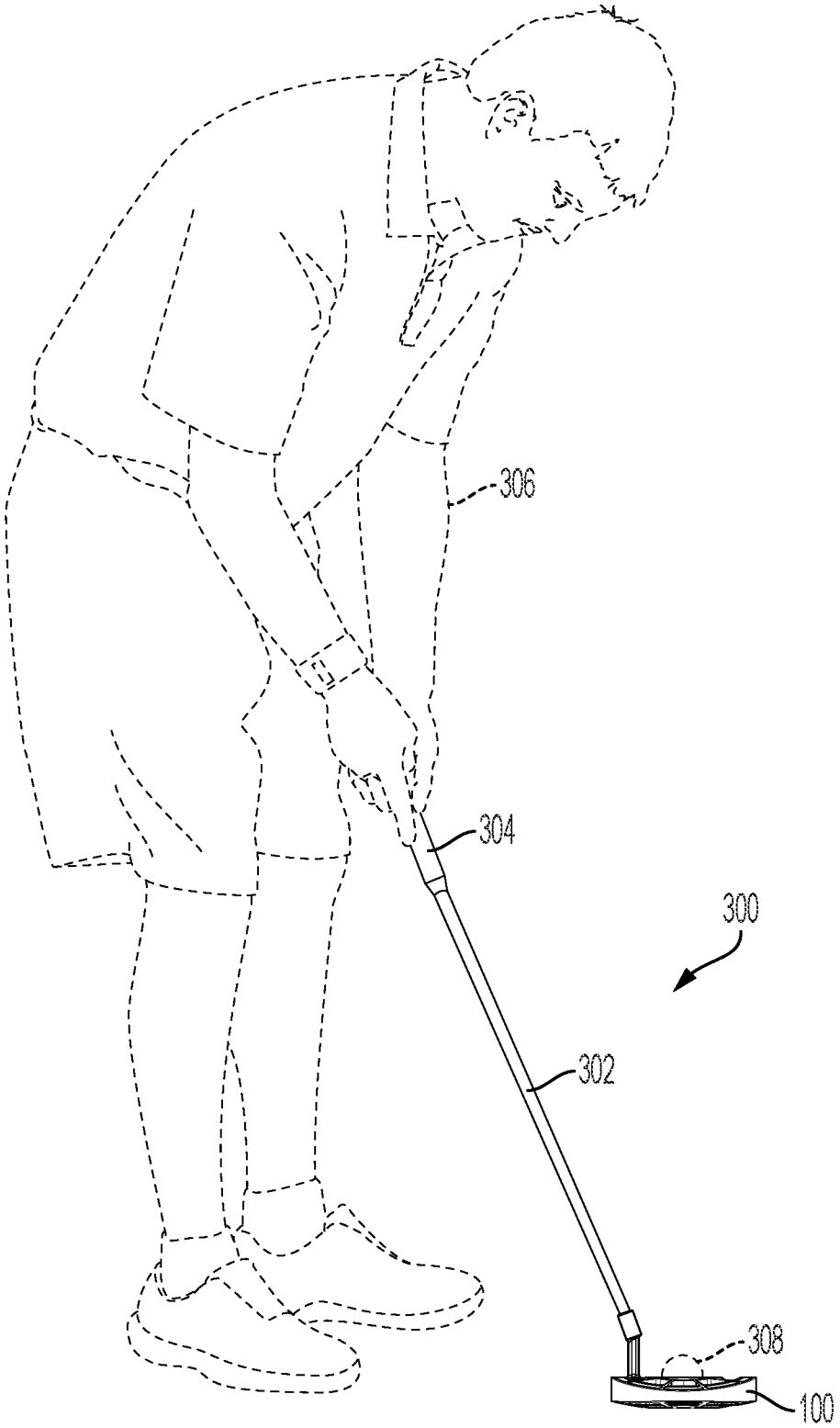
FIG. 5 depicts an isometric view illustrating a golfer using some of the elements of the embodiment shown in FIG. 1.

Referring to FIG. 5, a golfer 306 is shown using an embodiment of putter 100, 200 to strike golf ball 308. The putter 300 includes a shaft 302 and a grip 304. The shaft 302 is connected to the putter 100, 200 as discussed above. Similar embodiments are contemplated for any disclosed configuration disclosed herein.

In accordance with the features of the instant invention, a golfer 306 is able to hit an off-center putt and experience the ball 308 traveling only slightly less distance than an on-center impact at the same velocity. Typically, off-center impact with known putters causes the putters to vibrate which leads to a less solid feeling, less distance, and less satisfaction. In addition to other advantages, the due to the unique design, vibration of putter 100, 200, 300 is minimized during an off-center hit, thereby providing the golfer 306 with a more solid feeling, greater golf ball 308 travel distance, and greater satisfaction than is experienced with other known devices.

While the present disclosure has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A mallet style putter, the putter comprising:

a face, the face having a length and being connected to a semicircular support member forming a first semicircular aperture between the face and the semicircular support member;

a plurality of radial ribs, the plurality of radial ribs being connected to the semicircular support member thus forming a first plurality of radial apertures between each of the plurality of the radial ribs and the semicircular support member;

a first wall, the first wall being connected to the plurality of radial ribs and to a second wall in a concentric semicircular arrangement, the first wall and the second wall being separated by a connecting wall and forming a second plurality of apertures therebetween;

a plurality of gaps formed between the first wall and the face such that the face is connected to only the semicircular support member, wherein the plurality of gaps structurally isolates the face from the first wall and from the second wall; and a hosel, the hosel including a first cylindrical receptacle, a second cylindrical receptacle, and a stud, the stud protruding from a semicircular portion of the first wall, wherein the second cylindrical receptacle is configured to be connected to the stud, and wherein the first cylindrical receptacle is configured to be connected to the shaft.

2. The putter of claim 1, wherein the first semicircular aperture is filled with a high-density material.

3. The putter of claim 2, wherein the high-density material has a density between about 5 g/cc and about 20 g/cc and comprises between about 60% and about 80% of a mass of the putter.

4. The putter of claim 2, wherein the high-density material comprises tungsten powder.

5. The putter of claim 2, wherein the high-density material is dimpled.

6. The putter of claim 1, wherein at least one of the first plurality of apertures is filled with a high-density material.

7. The putter of claim 1, wherein at least one of the second plurality of apertures is filled with a high-density material.

8. The putter of claim 1, wherein the plurality of radial ribs is four radial ribs.

9. The putter of claim 1, wherein the first plurality of apertures is three apertures.

10. The putter of claim 1, wherein the second plurality of apertures is five apertures.

11. The putter of claim 1, wherein the plurality of radial ribs is four radial ribs, the first plurality of apertures is three apertures and the second plurality of apertures is five apertures.

12. The putter of claim 1, wherein the face length is between about 1.5 inches and about 3 inches.

13. A blade style putter, the putter comprising:

a face, the face having a length and being connected to a semicircular support member forming a semicircular aperture between the face and the semicircular support member;

a pair of ribs connected to the semicircular support member thus forming a first aperture between the pair of ribs and the semicircular support member;

a first wall, the first wall being connected to the pair of radial ribs and to a second wall, the first wall and the second wall being separated by a connecting wall, and forming at least two apertures therebetween, a plurality of gaps formed between the first wall and the face such that the face is connected to only the semicircular support member, wherein the plurality of gaps structurally isolates the face from the first wall and from the second wall; and a hosel, the hosel including a first cylindrical receptacle, a second cylindrical receptacle, and a stud, the stud protruding from a semicircular portion of the first wall, wherein the second cylindrical receptacle is configured to be connected to the stud, and wherein the first cylindrical receptacle is configured to be connected to the shaft.

14. The putter of claim 13, wherein the semicircular aperture is filled with a high-density material.

15. The putter of claim 13, wherein the first aperture is filled with a high-density material.

16. The putter of claim 13, wherein at least one of the at least two apertures is filled with a high-density material.

17. The putter of claim 13, wherein the high-density material has a density between about 5 g/cc and about 20 g/cc and comprises between about 60% and about 80% of a mass of the putter.

18. The putter of claim 13, wherein the high-density material comprises tungsten powder.

19. The putter of claim 13, wherein the high-density material is dimpled.

20. The putter of claim 13, wherein the face length between about 1.5 inches and about 3 inches.

* * * * *